US006303254B1

(12) United States Patent
Yu et al.

(10) Patent No.: US 6,303,254 B1
(45) Date of Patent: Oct. 16, 2001

(54) ELECTROSTATOGRAPHIC IMAGING MEMBER

(75) Inventors: Robert C. U. Yu, Webster; Terry L. Street, Fairport; Moritz P. Wagner, Walworth, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/692,855

(22) Filed: Oct. 20, 2000

(51) Int. Cl.[7] ..... G03G 5/10
(52) U.S. Cl. ..... 430/56; 430/60; 430/69
(58) Field of Search ..... 430/69, 56, 60

(56) References Cited

U.S. PATENT DOCUMENTS

| | | | | |
|---|---|---|---|---|
| 4,647,521 | | 3/1987 | Oguchi et al. | 430/58 |
| 4,654,284 | | 3/1987 | Yu et al. | 430/59 |
| 4,664,995 | | 5/1987 | Horgan et al. | 430/59 |
| 4,869,982 | | 9/1989 | Murphy | 430/48 |
| 5,021,309 | | 6/1991 | Yu | 430/58 |
| 5,096,792 | | 3/1992 | Simpson | 430/58 |
| 5,096,795 | | 3/1992 | Yu | 430/59 |
| 5,215,839 | | 6/1993 | Yu | 430/58 |
| 5,725,983 | | 3/1998 | Yu | 430/58 |
| 5,919,590 | * | 7/1999 | Yu et al. | 430/56 |
| 6,071,662 | * | 6/2000 | Carmichael et al. | 430/69 |
| 6,117,603 | * | 9/2000 | Yu et al. | 430/58.2 |

* cited by examiner

*Primary Examiner*—John Goodrow
(74) *Attorney, Agent, or Firm*—John L. Haack

(57) ABSTRACT

An electrostatographic imaging member including: a flexible supporting substrate; an imaging layer having an optional adjacent ground strip layer coated on one side of the substrate; and an anti-curl backing layer coated on the other side of the substrate which layer is comprised of a film forming polymer binder, an optional adhesion promoting polymer, and a dispersion of polytetrafluoroethylene particles which dispersion has particles with a narrow diameter particle size distribution of from about 0.19 micrometer to about 0.21 micrometer, and an average diameter particle size of about 0.20 micrometer. The optional ground strip layer can include the same dispersion of polytetrafluoroethylene particles as the anti-curl backing layer.

22 Claims, 5 Drawing Sheets

ELECTROSTATOGRAPHIC IMAGING MEMBER

CROSS REFERENCE TO COPENDING APPLICATIONS

Attention is directed to commonly assigned copending application: U.S. Ser. No. 09/ not yet assigned (D/A0077) filed concurrently herewith, entitled "ELECTROSTATOGRAPHIC IMAGING MEMBER PROCESS" discloses a process including providing at least a flexible substrate layer having a first major surface on one side and a second major surface on a second side opposite the first major surface, the first major surface being an exposed surface, applying a coating of an anti-curl backing layer dispersion on the first major surface of the substrate layer, the dispersion comprising a volatile carrier liquid, a film forming polymer dissolved in the volatile carrier liquid, solid organic particles dispersed in the volatile carrier liquid, and a dissolved organic additive polymer; and drying the coating to remove the volatile carrier and form a dried anti-curl backing layer. An electrostatographic imaging member containing the resulting anti-curl backing layer is also described.

The disclosures of the above mentioned copending application is incorporated herein by reference in its entirety. The appropriate components and processes of these patents may be selected for the toners and processes of the present invention in embodiments thereof.

BACKGROUND OF THE INVENTION

The present invention relates to flexible electrostatographic imaging belt members and, more specifically, to imaging belts having mechanically robust outer exposed layers that possess, for example, anti-curl backing layers or ground strip layers with enhanced wear resistance and optical transparency properties.

Flexible electrophotographic imaging members are well known in the art. Typical electrostatographic flexible imaging members include, for example, photosensitive members, such as photoreceptors, commonly utilized in electrophotographic, such as xerographic processes and electroreceptors, and ionographic imaging members for electrographic imaging systems. The flexible electrostatographic imaging members may be seamless or seamed belts. Typical electrophotographic imaging member belts comprise an imaging layer which is a charge transport layer and a charge generating layer on one side of a supporting substrate layer and an anti-curl backing layer coated on the opposite side of the substrate layer. A typical electrographic imaging member belt comprises a dielectric imaging layer on one side of a supporting substrate and an anti-curl backing layer on the opposite side of the substrate. A typical flexible electrostatographic imaging member belt has a ground strip coated near one edge of the belt and adjacent to the imaging layer.

Flexible electrophotographic imaging belt members may comprise a photoconductive layer comprising a single layer or composite layers. One type of composite photoconductive layer used in electrophotography is illustrated in U.S. Pat. No. 4,265,990, which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer sandwiched between the contiguous charge transport layer and the conductive layer, the outer surface of the charge transport layer is normally charged with a uniform charge of a negative polarity and the supporting electrode is utilized as an anode. The supporting electrode may still function as an anode when the charge transport layer is sandwiched between the supporting electrode and the photoconductive layer. The charge transport layer in this latter embodiment must be capable of supporting the injection of photogenerated electrons from the photoconductive layer and transporting the electrons through the charge transport layer. Photosensitive members having at least two electrically operative layers, as disclosed above, provide excellent electrostatic latent images when charged with a uniform negative electrostatic charge, exposed to a light image and then developed with finely divided electroscopic marking particles. The resulting toner image is usually transferred to a suitable receiving member such as paper.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For electrophotographic imaging members having a belt configuration, the numerous layers found in modem photoconductive imaging members must be highly flexible, adhere well to adjacent layers, and exhibit predictable electrical characteristics within narrow operating limits to provide excellent toner images over many thousands of cycles. One type of multi-layered photoreceptor that has been employed as a belt in electrophotographic imaging systems comprises a substrate, a conductive layer, a blocking layer, an adhesive layer, a charge generating layer, a charge transport layer, and a conductive ground strip layer adjacent to one edge of the imaging layers. This photoreceptor belt may also comprise additional layers such as an anti-curl backing layer to achieve the desired belt flatness. An optional overcoating layer over the charge transport layer may be used for additional wear, environmental, and chemical protection.

In a machine service environment, a flexible imaging member belt, mounted on a belt supporting module, is generally exposed to repetitive electrophotographic image cycling which subjects the exposed anti-curl backing layer to abrasion due to mechanical fatigue and interaction with the belt drives and other support rollers as well as sliding contact with backer bars. This repetitive cycling leads to a gradual deterioration in the physical/mechanical integrity of the exposed anti-curl backing layer. When the anti-curl layer is worn the thickness thereof is reduced and the anti-curl backing layer experiences a loss of ability to counteract the tendency of imaging members to curl upwardly thereby leading to belt curl. Moreover, uneven wear of the anti-curl backing layer has been found to cause early development of belt ripples which are ultimately manifested as copy printout defects. Thus, the anti-curl backing layer wear that results from mechanical contact interaction during dynamic imaging operations is a significant problem that shortens the service life of the belt and adversely affects image quality.

When a production web stock of several thousand feet of coated multi-layered photoreceptor is rolled up, the charge transport layer and the anti-curl layer are in intimate contact. The high surface contact friction of the charge transport layer against the anti-curl layer causes dimples and creases to develop in the internal layers of the photoreceptor. Since these physically induced defects manifest themselves as print defects in xerographic copies, the unacceptable segments of this photoreceptor web stock are discarded thereby decreasing production yield. Although attempts have been made to overcome these problems, the solution of one problem often leads to the generation of additional problems.

Flexible photoreceptor belts are fabricated from sheets cut from an electrophotographic imaging member web stock. The cut sheets are generally rectangular in shape. All edges may be of the same length or one pair of parallel edges may be longer than the other pair of parallel edges. The sheet is formed into a belt by joining the overlapping opposite marginal end regions of the sheet. A seam is typically produced in the overlapping opposite marginal end regions at the point of joining. Joining may be effected in any suitable manner, such as welding including for example ultrasonic processes, gluing, taping, pressure/heat fusing, and the like methods. However, ultrasonic seam welding is generally the preferred method of joining because it is rapid, clean, generally free of solvent application, and produces a thin and narrow seam. The ultrasonic seam welding process involves a mechanical pounding action of a welding horn which generate a sufficient amount of heat energy at the contiguous overlapping marginal end regions of the imaging member sheet to maximize melting of one or more layers therein. A typical ultrasonic welding process is carried out by holding down the overlapping ends of the flexible imaging member sheet with vacuum onto a flat anvil and guiding the flat end of the ultrasonic vibrating horn transversely across the width of the sheet and directly over the overlapped junction to form a welded seam having two adjacent seam splashings consisting of the molten mass of the imaging member layers ejected to the either side of the welded overlapped seam. These seam splashings of the ejected molten mass comprise about 40 percent by weight of anti-curl layer material. The splashings can include hard crystalline materials and have a rough abrasive outer surface which abrades the photoreceptor cleaning blade during dynamic image cycling causing the blade to lose cleaning efficiency and shortens blade service life.

Alteration of material formulation in the anti-curl backing layer of imaging member belt can enhance wear resistance and extend life, but this enhancement can lead to certain undesirable outcomes. For example, incorporation of crystalline particles in the outermost exposed layers of the imaging member to improve wear resistance has been observed to cause excessive wear of the ultrasonic horn used to ultrasonically weld the seams of imaging belts. Other prior art approaches, reference for example, U.S. Pat. Nos. 5,096,795 and 5,725,983, demonstrate that to resolve imaging member coating layer wear problems, synthetic organic particles as well as blends of organic and inorganic particle dispersions can be incorporated into the exposed anti-curl backing layer of the imaging member and can thereby improve abrasion resistance. However, such incorporation often caused bubble formation in the dried anti-curl backing layer. These bubbles adversely affect the thickness uniformity of the layer which in turn affects critical physical characteristics such as, for example, alteration of intimate surface contact friction requirements between the anti-curl backing layer and the drive-roller of the belt support module. This alteration of friction adversely impacts the driving capacity of drive-rollers and causes imaging belt slippage during dynamic belt operation. Moreover, the alteration has also been found to reduce the mechanical strength of anti-curl backing layers and capability to resist fatigue induced anti-curl backing layer cracking. The presence of bubbles in the anti-curl backing layer can also negate and diminish the benefit of wear resistance enhancements that are otherwise achievable through dispersion of organic particles in imaging members by, for example, increasing wear rate. Also the presence of bubbles can weaken the layer and cause premature cracking of the imaging member when fatigue tension/compression strain is repeatedly applied to the anti-curl backing layer during machine cycling, particularly during fatigue cycling around small diameter support rollers. Further, when rear or back erase is employed to discharge the photoreceptor belt during electrophotographic imaging processes, the presence of bubbles can cause light scattering which can lead to undesirable non-uniform discharge of the imaging member. Also, the presence of bubbles in the anti-curl backing layer during seam welding processes cause the bubbles to expand and form splashings having open pits. During electrophotographic imaging and cleaning cycles, these open pits can function as sites that trap toner, debris, and dirt particles making attempts to clean the imaging member belt extremely difficult. It has also been found that, during imaging belt cycling, the trapped toner, debris, and dirt particles can be carried out by the cleaning blade from the pits to contaminate vital imaging componentry, such as lenses, Hybrid Scavengeless Development (HSD), Hybrid Jumping Development (HJD), and other subsystems, and can also lead to undesirable artifacts which form undesirable print defects in the final image copies. An additional shortcomings of organic and inorganic fillers dispersion in the outer exposed anti-curl backing layer include the creation of surface protrusions, that is particulate filler materials which extend beyond the boundaries of the coating film layer. Protrusions can diminish the optical clarity of the resulting layer and interfere, for example, with efficient back erase discharge.

A flexible electrophotographic imaging belt member's ground strip is typically coated adjacent to the charge transport layer and is also an outer exposed layer. The ground strip layer is constantly subjected to mechanical action by, for example, static grounding devices or the sliding motion of cleaning blades during xerographic imaging or cleaning processes. Premature ground strip wear-through has been identified as a problem which requires immediate replacement of the belt. A ground strip wear-through site not only can disrupt electrical conductivity, the wear-through site also functions like an aberrant timing hole which can generate faulty belt cycling registration signals.

There remains a need for simple and efficient method for improving the shortcomings of the abovementioned anti-curl backing layers and ground strip layers in electrostatographic imaging belt members. In embodiments, the imaging member articles and apparatus of present invention provide unexpected benefits and superior productivity performance levels in electrostatographic imaging processes. These and other advantages of the present invention are illustrated herein.

PRIOR ART

In U.S. Pat. No. 5,021,309, issued Jun. 4, 1991, to Yu, there is disclosed an electrophotographic imaging device with an exposed anti-curl layer with organic fillers dispersed therein. The fillers provide coefficient of surface contact friction reduction, increased wear resistance, and improved adhesion of the anti-curl layer, without adversely affecting the optical and mechanical properties of the imaging member.

In U.S. Pat. No. 5,096,795, issued Mar. 17, 1992, to Yu, there is disclosed an electrophotographic imaging device with material for exposed layers which contains either organic or inorganic particles uniformly dispersed therein. The particles provide reduced coefficient of surface contact friction, increased wear resistance, durability against tensile cracking and improved adhesion of the layers without adversely affecting the optical and electrical properties of the imaging member.

In U.S. Pat. No. 5,725,983, issued Mar. 10, 1998, to Yu, there is disclosed an electrophotographic imaging member comprising a supporting substrate having an electrically conductive layer, a hole blocking layer, an optional adhesive layer, a charge generating layer, a charge transport layer, an anti-curl back coating, a ground strip layer and an optional overcoating layer, at least one of the charge transport layer, anti-curl back coating, ground strip layer and overcoating layer comprising a blend of inorganic and organic particles homogeneously distributed in a weight ratio of between about 3:7 and about 7:3 in a film forming matrix, the inorganic particles and organic particles having a particle diameter less than about 4.5 micrometers. These electrophotographic imaging members may have a flexible belt form or rigid drum configuration. These imaging members may be utilized in an electrophotographic imaging process.

In U.S. Pat. No. 4,647,521, issued Mar. 3, 1987, to Oguchi et al., there is disclosed a photosensitive member or image holding member, for electrophotography having a conductive substrate, a top layer for holding an electrostatic image and/or toner image wherein the top layer is formed by applying a coating fluid containing hydrophobic silicon and a binder resin.

In U.S. Pat. No. 4,654,284, issued Mar. 31, 1987, to Yu et al., there is disclosed an imaging member comprising at least one flexible electrophotographic imaging layer, a flexible supporting substrate layer having an electrically conductive surface and an anti-curl layer, the anti-curl layer comprising a film forming binder, crystalline particles dispersed in the film forming binder and a reaction product of a bifunctional chemical coupling agent with both the film forming binder and the crystalline particles. This imaging member may be employed in an electrostatographic imaging process.

In U.S. Pat. No. 4,664,995, issued May 12, 1987, to Horgan et al., there is disclosed an electrostatographic imaging member comprising at least one imaging layer capable of retaining an electrostatic latent image, a supporting substrate layer having an electrically conductive surface, and an electrically conductive ground strip layer adjacent the electrostatographic imaging layer and in electrical contact with the electrically conductive layer, the electrically conductive ground strip layer comprising a film forming binder, conductive particles and crystalline particles dispersed in the film forming binder, and a reaction product of a bifunctional chemical coupling agent with both the film forming binder and the crystalline particles. This imaging member may be employed in an electrostatographic imaging process.

In U.S. Pat. No. 4,869,982, issued Sep. 26, 1989, to Murphy, there is disclosed an electrophotographic photoreceptor is disclosed containing a toner release material in one or more electrically operative layers such as a charge transport layer. From about 0.5 to about 20 percent of a toner release agent selected from stearates, silicon oxides and fluorocarbons is incorporated into an imaging layer such as a charge transport layer.

In U.S. Pat. No. 5,215,839, issued Jun. 1, 1993, to Yu, there is disclosed a layered electrophotographic imaging member. The member is modified to reduce the effect of interference caused by the reflections from coherent light incident on a ground plane. Modification involves an interface layer between a blocking layer and a charge generation layer, the interface layer comprising a polymer having incorporated therein filler particles of a synthetic silica or mineral particles. The filler particles scatter the light to prevent reflections from the ground planes back to the light incident on the surface.

In U.S. Pat. No. 5,096,792, issued Mar. 17, 1992, to Simpson et al., there is disclosed a layered photosensitive imaging member which is modified to reduce the effects of interference within the member caused by reflections from coherent light incident on a base ground plane. The modification involves a ground plane surface with a rough surface morphology by various selective deposition methods. Light reflected from the ground plane formed with the rough surface morphology is diffused through the bulk of the photosensitive layer breaking up the interference fringe patterns which are later manifested as a plywood pattern on output prints made from the exposed sensitive medium.

SUMMARY OF THE INVENTION

Embodiments of the present invention, include:

An electrostatographic imaging member comprising:

a flexible supporting substrate;

an imaging layer coated on one side of the substrate;

an optional ground strip layer coated adjacent to the imaging layer; and an anti-curl backing layer coated on the other side of the substrate which layer is comprised of a film forming polymer binder, optionally an adhesion promoting polymer, and a dispersion of polytetrafluoroethylene particles and which dispersion has particles with a narrow diameter particle size distribution of about 0.19 micrometers to about 0.21 micrometers, and an average diameter particle size of about 0.20 micrometers; and An electrophotographic layered imaging member respectively comprising:

an anti-curl backing layer, a flexible supporting substrate having an electrically conductive layer, a hole blocking layer, an adhesive layer, a charge-generating layer, and a charge transport layer having an optional adjacent ground strip layer, wherein the anti-curl backing layer comprises a film forming polymer binder and a dispersion of polytetrafluoroethylene particles, wherein the particles have a narrow diameter particle size distribution of about 0.19 micrometers to about 0.21 micrometers, and an average diameter particle size of about 0.20 micrometers.

The present invention provides imaging member belts with either or both an anti-curl backing layer and a ground strip layer and which layers possess: a modified particle dispersion in the bulk matrix of either layer that produces minimal coating layer surface protrusions; enhanced wear resistance properties; enhanced optical clarity; superior lubrication characteristics of the anti-curl backing layer such as seam splashing surface lubrication; suppressed belt ripple defects during dynamic imaging belt cycling; a seam splashing morphology that resists the early onset of fatigue bending induced seam cracking and delamination; mechanically robustness and clean machine belt cycling with minimum wear and generation of debris and dust; reduced surface contact friction between the charge transport layer and the anti-curl back coating in rolled up web stock; dispersed particles which do not cause ultrasonic horn wear during the ultrasonic welding of seams to form belts; belts that are free of belt wrinkles, puckering, and ripples; and are free of bubble defects. The present invention is useful in electrostatographic imaging processes and apparatus, for example, in electrophotographic imaging. These and other embodiments of the present invention are illustrated herein.

DETAILED DESCRIPTION OF THE INVENTION

Figure 1:
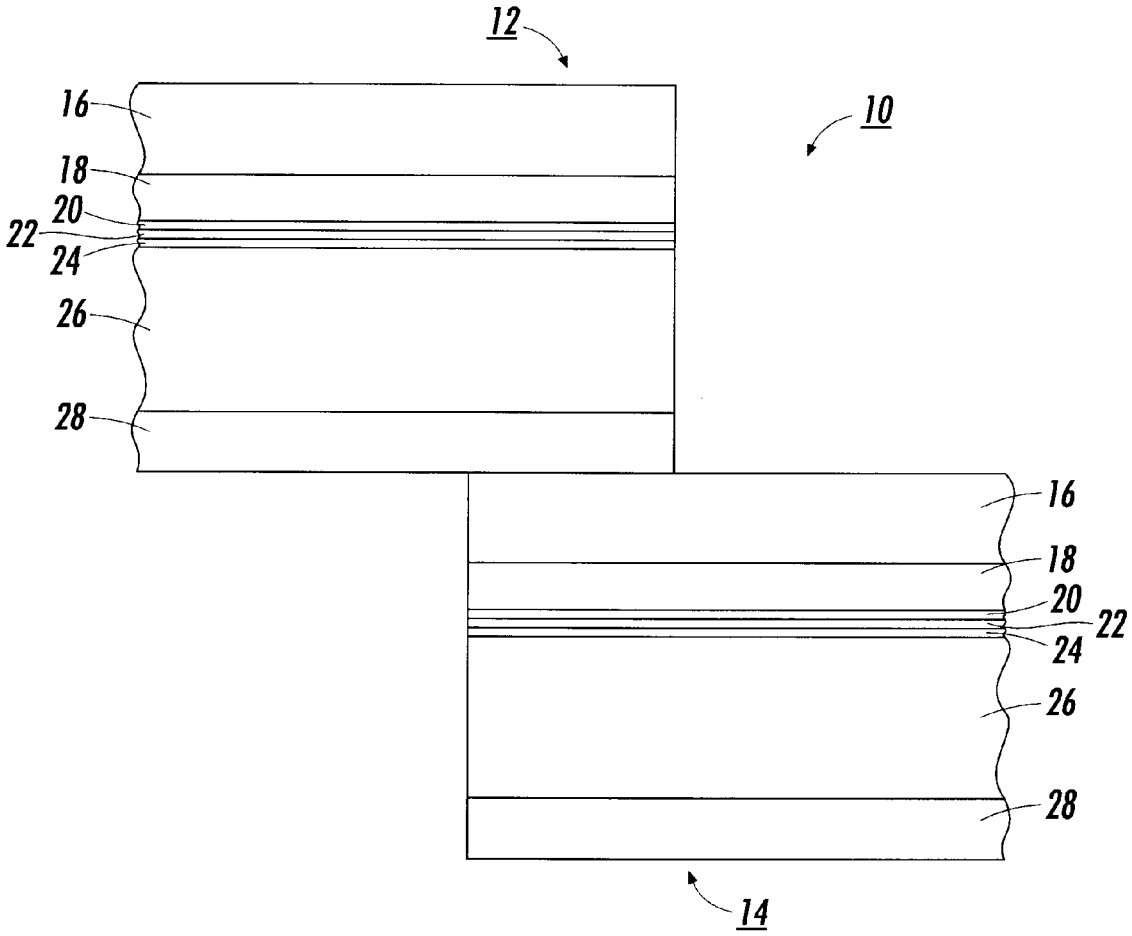
FIG. 1 illustrates a schematic partial cross-sectional side view of a multiple layered flexible sheet of electrophotographic imaging material with opposite ends overlapped.

For simplicity the following discussions focus mainly on fabricating flexible electrophotographic imaging member belts, such as photoreceptor belts. However, it is readily understood that the discussions are equally applicable to fabricating electrographic imaging members, for example, ionographic belts. Flexible electrophotographic imaging member belts generally comprise a supporting substrate having an electrically conductive surface, an optional hole blocking layer, an optional adhesive layer, a charge generating layer, a charge transport layer, an anti-curl backing layer, a ground strip layer and an optional overcoating layer. The exposed anti-curl backing layer and the ground strip layer fabricated by the material formulation of this invention comprises synthetic sub-micrometer organic particles homogeneously dispersed in a film forming polymer matrix which overcomes the deficiencies of prior anti-curl backing layers and ground strip layers.

In embodiments the present invention provides an electrostatographic imaging member comprising:

a flexible supporting substrate;

an imaging layer coated on one side of the substrate; and an anti-curl backing layer coated on the other side of the substrate which layer is comprised of a film forming polymer binder, optionally an adhesion promoting polymer, and a dispersion of polytetrafluoroethylene particles and which dispersion has particles with a narrow diameter particle size distribution of about 0.19 micrometers to about 0.21 micrometers, and an average diameter particle size of about 0.20 micrometers. The electrostatographic imaging member, in embodiments, can further comprise a ground strip layer coated at one edge of the imaging member and adjacent to the imaging layer and which ground strip layer is comprised of a film forming polymer, a conductive graphite dispersion, and a dispersion of polytetrafluoroethylene particles which dispersion has a narrow diameter particle size distribution of about 0.19 micrometers to about 0.21 micrometers, and an average diameter particle size of about 0.20 micrometers. In embodiments, the polytetrafluoroethylene particles in the anti-curl backing layer can be present in amounts of from about 0.1 to about 30 weight percent based on the total weight of the anti-curl layer. In preferred embodiments the polytetrafluoroethylene particles in the anti-curl backing layer can be present in an amount of from about 2 to about 15 weight percent based on the total weight of the anti-curl layer. This range of polytetrafluoroethylene particles is preferred because is tends to provide imaging members with optimum mechanical properties when made with conventional ingredients and prepared by known methods. In embodiments the above mentioned polytetrafluoroethylene particles contained in the ground strip layer can be, for example, present in amounts of from about 0.1 to about 30 weight percent based on the total weight of the ground strip layer.

In embodiments, the polytetrafluoroethylene particles are preferably gamma-ray irradiated or electron-beam irradiated. Although not wanting to be limited by theory it is believed that the aforementioned irradiation can harden the surface and bulk properties of the particles and improve the primary particle properties of the material, that is, the dispersability of the particles as primary particles into coating formulations and the degree of dispersion of the primary particles in the resulting coated layers. In a preferred embodiment, the polytetrafluoroethylene particles are prepared by dispersion polymerization. Although not wanting to be limited by theory it is believed that the aforementioned dispersion polymerization preparative method provides PTFE particles with the aforementioned primary particle properties and many or all of the improvements in the resulting imaging members. It will be readily appreciated by one of ordinary skill in the art upon comprehending the teaching of the present invention that the polytetrafluoroethylene particles of the present invention when formulated into an imaging member as disclosed and illustrated herein have superior dry lubricating characteristics and superior performance characteristics compared to related but materially distinct PTFE formulations which possess different physical-chemical properties as summarized herein. For example, the morphology of the polytetrafluoroethylene particles is preferably substantially spherical and more preferably completely spherical, and more preferably polytetrafluoroethylene particles where the surface of the particles, for example, in embodiments is substantially smooth and is free of major protrusions, irregularities, or roughness. In embodiments, the polytetrafluoroethylene particles size distribution is preferably substantially monomodal, for example, in embodiments a geometric size distribution (GSD) can be from about 1.0 to about 1.5, and preferably from about 1.0 to about 1.2, and most preferably from about 1.0 to about 1.1. It should be readily evident to one of ordinary skill in the art that a preferred disposition of the polytetrafluoroethylene particles, for example when dispersed in the binder layer of either or both a anti-curl backing layer and a ground strip layer, is as primary particles, that is, where substantially all or most of the PTFE particles are separated from one another by at least some polymer binder or other non-PTFE particle material and where there is little or no noticeable or measurable particle aggregation or agglomeration. Thus in preferred embodiments of the present invention there are provided imaging members containing a anti-curl backing layer and optionally a ground strip layer where the polytetrafluoroethylene particles are uniformly and homogeneously dispersed in the binder. The anti-curl backing layers of electrostatographic imaging members of the present invention can be formulated with a variety of known suitable resin or resin mixtures. A preferred class of resin for formulating the anti-curl backing layers is polycarbonates. Similarly, a binder resin of choice for formulating the ground strip layer is a polycarbonate. A particularly preferred polycarbonate formulation for the present invention, for either or both the anti-curl backing layer or the ground strip layer, is a combination of at least one of poly(4,4'-isopropylidene diphenylene carbonate) and at least one 4,4,-cyclohexylidene diphenyl polycarbonate.

The anti-curl backing layers of electrostatographic imaging members of the present invention can be formulated with a thickness, for example, of from about 0.25 to about 100 micrometers. The anti-curl backing layers prepared in accordance with the present invention are highly transparent to infrared radiation and are preferably optically clear to infrared radiation. Thus the anti-curl backing layers of electrostatographic imaging members of the present invention are particularly well suited for use in known infrared radiation back erase schemes and processes. Although not wanting to be limited by theory it is believed that because of the PTFE particle properties, such as the small average particle size, the narrow particle size distribution, the highly spheroidal shape, the absence of surface irregularities, for example, nooks, crannies, protrusions, or protuberances, and the relative hardness, the resulting anti-curl layers prepared with the PTFE particles in accordance with the present invention are incapable of trapping gas particles on the surface or in the particle bulk so that the formulated PTFE particles and there resulting particle containing film dispersions are substantially or entirely free of entrapped gas particles, for example, air bubbles, solvent vapors, residual monomer outgas, and the like entrapped gas particles, that may arise during coating formulation or coating deposition process steps.

In embodiments, the anti-curl backing layers of the electrostatographic imaging members of the present invention can have exceptional and unexpected improved wear resistance properties of, for example, from about 5 to about 1,000 times greater than a comparable or control anti-curl layer prepared free of the aforementioned PTFE particles. In embodiments, the resulting the anti-curl backing layer of electrostatographic imaging members can have wear resistance properties preferably from about 100 to about 750 times greater than an anti-curl layer free of the aforementioned PTFE particles. For example, an anti-curl layer containing about 10 weight percent monomodal polytetrafluoroethylene particle dispersion, had a wear resistance of about 500 times greater than a comparable electrostatographic imaging member with an anti-curl layer that was free of the polytetrafluoroethylene particles.

The anti-curl backing layers of the present invention can have coated contact surfaces with coefficient of surface contact friction values, for example, when contacted by or against a charge transport layer of from about 0.1 to about 0.7. In the examples imaging members with anti-curl backing layers formulated in accordance with the present invention had a coefficient of surface contact friction against charge transport layers of about 0.5 to about 0.7 or about 17 percent compared to the frictional value for a comparable imaging and an anti-curl backing layer formulated in accordance with the present invention with the exception that the anti-curl layer was prepared free of the uniformly small and uniformly sized PTFE particles.

In embodiments, the electrostatographic imaging members of the present invention can include an anti-curl backing layer which further comprises an optional adhesion promoter compound and which compound promotes adhesion of the anti-curl layer to adjacent or subjacent coating or surfaces. The adhesion promoter can be, for example, a known and suitable polyester or copolyester compound present in an amount of, for example, about 1 percent by weight to about 15 percent by weight of the anti-curl layer.

In embodiments of the present invention there is provided an electrophotographic layered imaging member respectively comprising:

an anti-curl backing layer, a flexible supporting substrate having an electrically conductive layer, a hole blocking layer, an adhesive layer, a charge-generating layer, and a charge transport layer, wherein the anti-curl backing layer comprises a film forming polymer binder and a dispersion of polytetrafluoroethylene particles, wherein the particles have a narrow diameter particle size distribution of about 0.19 micrometers to about 0.21 micrometers, and an average diameter particle size of about 0.20 micrometers.

Referring to Figures, in FIG. 1 there is illustrated a flexible imaging member 10 in the form of a sheet having a first end marginal region 12 overlapping a second end marginal region 14 to form an overlap region ready for a seam forming operation. The flexible imaging member 10 can be utilized within an electrophotographic imaging member device and may be a member having a film substrate layer combined with one or more additional coating layers. At least one of the coating layers comprises a film forming binder. The flexible imaging member 10 may comprise multiple layers. If the flexible imaging member 10 is to be a negatively charged photoreceptor device, the flexible imaging member 10 may comprise a charge generator layer sandwiched between a conductive surface and a charge transport layer. Alternatively, the flexible member 10 may comprise a charge transport layer sandwiched between a conductive surface and a charge generator layer.

The layers of the flexible imaging member 10 can comprise numerous suitable materials having suitable mechanical properties. Examples of typical layers are described in U.S. Pat. Nos. 4,786,570, 4,937,117 and 5,021,309, the entire disclosures thereof being incorporated herein by reference. The belt or flexible imaging member 10 shown in FIG. 1, including the two end marginal regions 12 and 14, comprises from top to bottom a charge transport layer 16, a generator layer 18, an interface layer 20, a blocking layer 22, a conductive ground plane layer 24, a supporting layer 26, and an anti-curl back coating layer 28. It is understood that the thickness of the layers can be conventional and that a wide range of thicknesses can be used for each of the layers. A 10 millimeters width ground strip layer (not shown) coated adjacent to the charge transport layer 16 and at one edge of the imaging member provides a conductivity connection to the ground plane layer 24.

Figure 2:
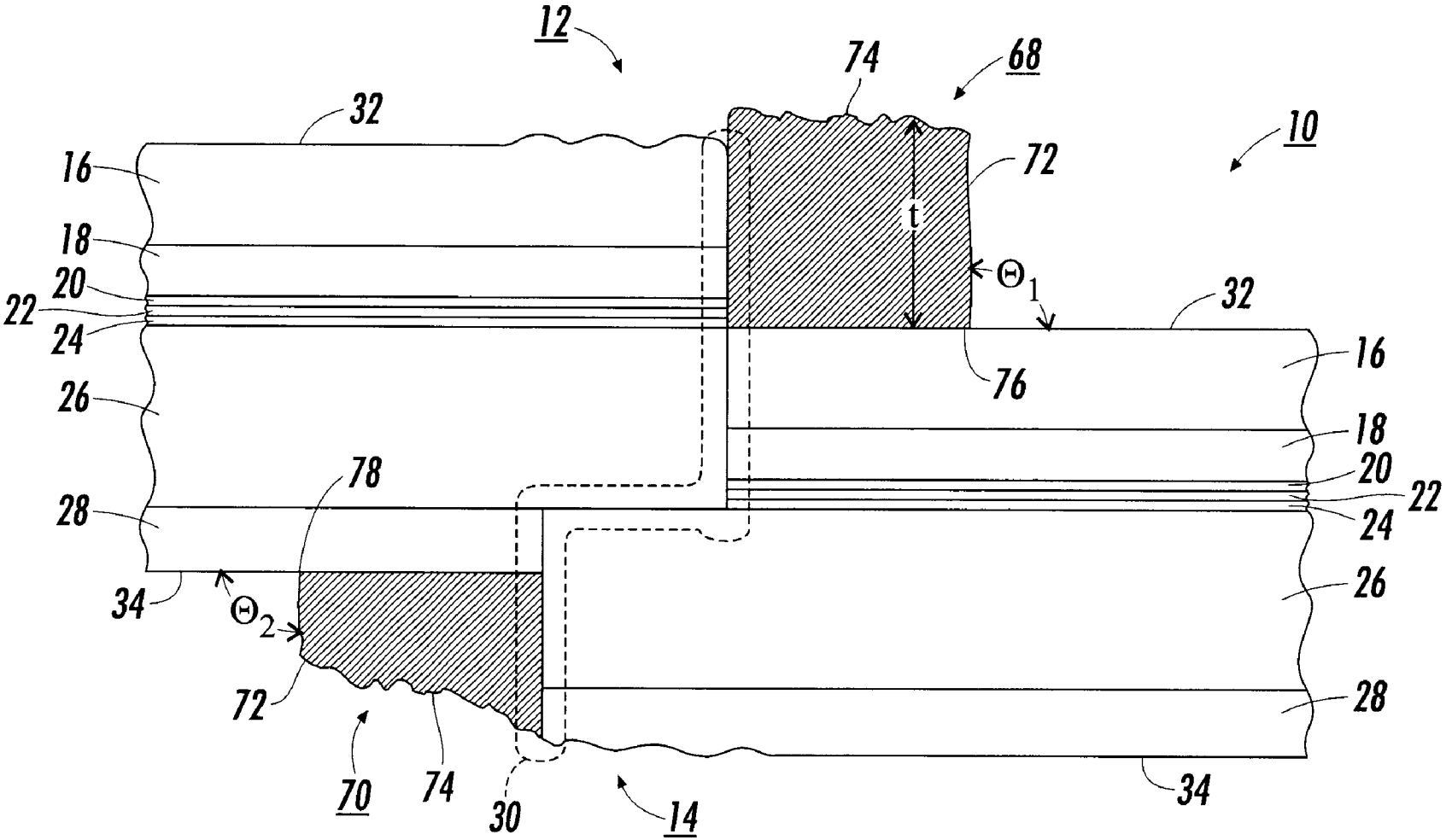
FIG. 2 shows a schematic partial cross-sectional side view of a multiple layered seamed flexible electrophotographic imaging belt member formed from the flexible sheet illustrated in FIG. 1.

Although the end marginal regions 12 and 14 can be joined by any suitable means including ultrasonic welding, gluing, taping, stapling, and pressure and heat fusing to form a continuous imaging member seamed belt, sleeve, or cylinder, nevertheless, for ease of belt fabrication, short operation cycle time, and mechanical strength of the fabricated joint, the ultrasonic welding process is preferably used to join the end marginal regions 12 and 14 of imaging member sheet 10 into a seam 30 in the overlap region, as illustrated in FIG. 2 to form a seamed flexible imaging member belt 10. As illustrated in FIG. 2, the location of seam 30 is indicated by a dotted line. Seam 30 comprises two vertical portions joined by a horizontal portion. Thus, the midpoint of seam 30 may be represented by an imaginary centerline extending the length of seam 30 from one edge to the opposite edge of belt 10, the imaginary centerline (not shown) running along the middle of the horizontal portion which joins the two vertical portions illustrated in FIG. 2. In other words, a plan view (not shown) of the horizontal portion of seam 30 would show a strip much like a two lane highway in which the centerline would be represented by the white divider line separating the two lanes, the two lanes comprising end marginal regions 12 and 14. The flexible imaging member 10 is thus transformed from a sheet of electrophotographic imaging member material as illustrated in FIG. 1 into a continuous electrophotographic imaging member belt 10 as illustrated in FIG. 2. The flexible imaging member belt 10 has a first major exterior surface or side 32 and a second major exterior surface or side 34 on the opposite side. The seam 30 joins the flexible imaging member 10 so that the bottom surface 34 (generally including at least one layer immediately above) at or near the first end marginal region 12 is integral with the top surface 32 (generally including at east one layer immediately below) at or near the second end marginal region 14.

When an ultrasonic welding process is employed to transform the sheet of flexible imaging member material into an imaging member belt, the seam of the belt is created by the high frequency mechanical pounding action of a welding horn over the overlapped opposite end regions of the imaging member sheet to cause material fusion. In the ultrasonic seam welding process, ultrasonic energy generated by the welding horn action, in the form of heat is applied to the overlap region to melt suitable layers such as the charge transport layer 16, generator layer 18, interface layer 20, blocking layer 22, part of the support layer 26 and/or anti-curl backing layer 28. The anti-curl backing layer 28 formed by the process of the present invention comprises synthetic organic particles, such as particular polytetrafluoroethylene particles, dispersed in a film forming polymer matrix. Direct fusing of the support layer achieves optimum seam strength.

Figure 3:
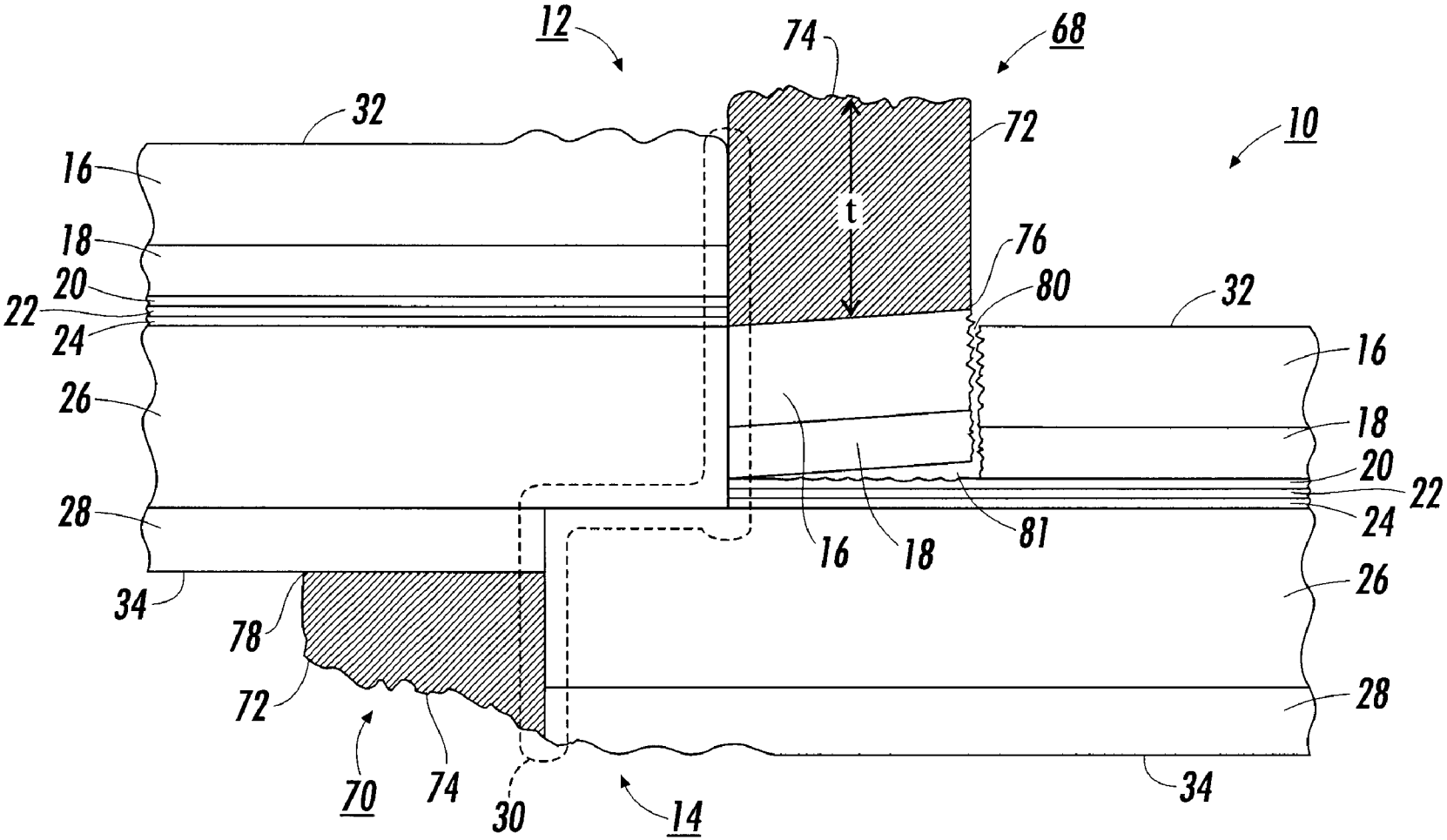
FIG. 3 illustrates a schematic partial cross-sectional side view of a failed multiple layered seamed flexible electrophotographic imaging belt member which failed from fatigue induced seam cracking and delamination.
Figure 4:
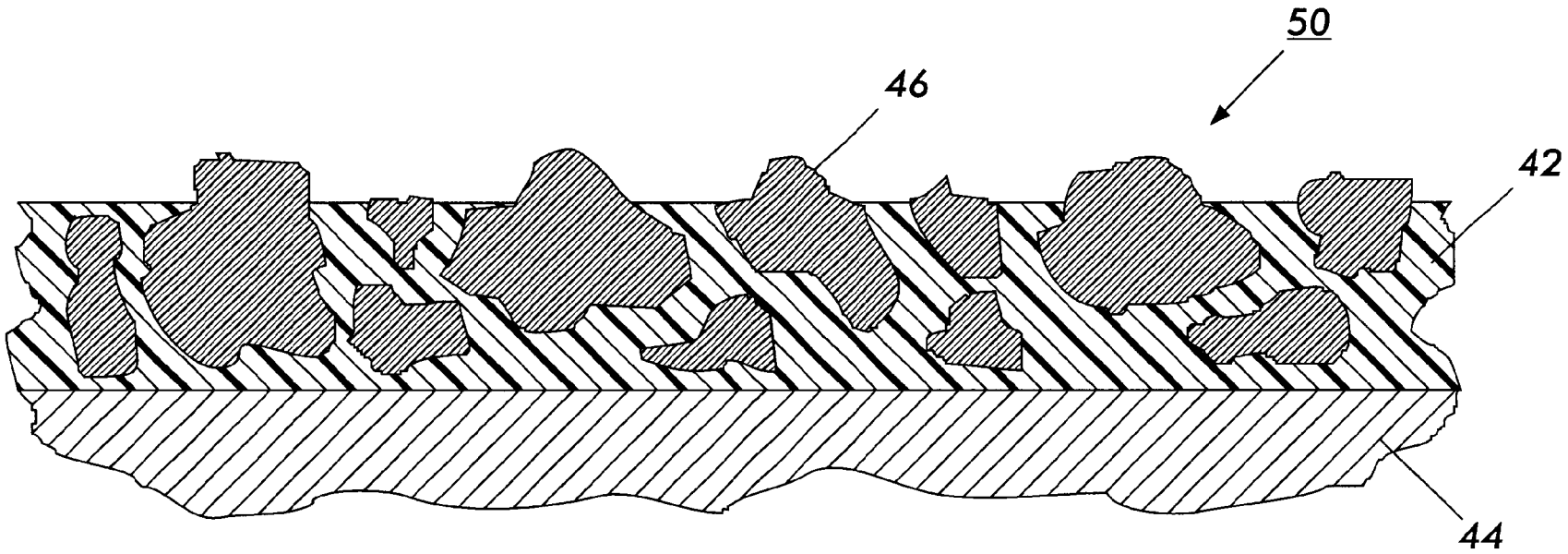
FIG. 4 is a schematic partial cross-sectional of a failed flexible electrophotographic imaging belt member with an anti-curl back coating layer formulated with large, broadly size distributed, and irregularly shaped POLYMIST® PTFE particles.

Upon completion of welding of the overlap region of the imaging member sheet into a seam 30 using ultrasonic seam welding techniques, the overlap region is transformed into an overlapping and abutting region as illustrated in FIGS. 2 and 3. Within the overlapping and abutting region, the portions of the flexible member belt 10, which once formed the end marginal regions 12 and 14, are joined by the seam 30 such that the once end marginal regions 12 and 14 are overlapping and abutting one another. The welded seam 30 contains upper and lower splashings 68 and 70 at each end thereof as illustrated in FIGS. 2 and 4. The splashings 68 and 70 are formed in the process of joining the end marginal regions 12 and 14 together. Molten material is necessarily ejected from either side of the overlap region to facilitate direct support layer 26 of one end to support layer 26 of the other end fusing and results in the formation of the splashings 68 and 70. The upper splashing 68 is formed and positioned above the overlapping end marginal region 14 abutting the top surface 32 and adjacent to and abutting the overlapping end marginal region 12. The lower splashing 70 is formed and positioned below the overlapping end marginal region 12 abutting bottom surface 34 and adjacent to and abutting the overlapping end marginal region 14. The splashings 68 and 70 extend beyond the sides and the edges of the seam 30 in the overlap region of the welded flexible member 10. The extension of the splashings 68 and 70 beyond the sides and the edges of the seam 30 is undesirable for many machines such as electrophotographic copiers, duplicators and copiers that require precise edge positioning of a flexible member belt 10 during machine operation. Generally, the extension of the splashings 68 and 70 at the parallel belt edges of the flexible member belt 10 are removed by a notching operation.

A typical upper splashing 68 has a height or thickness t of about 90 micrometers and projects about 17 micrometers above the surface of the overlapping end marginal region 12. Each of the splashings 68 and 70 has an uneven but generally rectangular cross sectional shape including one side (free side) 72 (which forms a free end) extending inwardly toward top surface 32 from an outwardly facing side 74 (extending generally parallel to both the top surface 32 or the bottom surface 34). The free side 72 of the splashing 68 forms an approximately perpendicular angle $\theta_1$ at junction 76 with the bottom surface 34 of the flexible member belt 10. Likewise, the free side 72 of the splashing 70 forms an approximately perpendicular angle $\theta_2$ at the junction 78 of the free side 72 of the lower splashing 70 and the bottom surface 34 of the flexible member belt 10. Both junctions 76 and 78 provide focal points for stress concentration and become the initial points of failure affecting the mechanical integrity of the flexible member belt 10.

During machine operation, the seamed flexible imaging member belt 10 cycles or bends over rollers, particularly small diameter rollers, of a belt support module within an electrophotographic imaging apparatus. As a result of dynamic bending of the flexible imaging member belt 10 during cycling, the rollers repeatedly exert a force on the flexible imaging member belt 10 which causes large stresses to develop generally adjacent to the seam 30 due to the excessive thickness and material discontinuity thereof. The stress concentrations that are induced by bending near the junction points 76 and 78 may reach values much larger than the average value of the stress over the entire length of the flexible member belt 10. The induced bending stress is inversely related to the diameter of a roller over which the flexible imaging member belt 10 bends and directly related to the thickness of the seam 30 of the flexible imaging member belt 10. When a structural member, such as the flexible member 10, contains an abrupt increase in cross-sectional thickness at the overlap region, high localized stress occurs near this discontinuity, for example, junction points 76 and 78.

When the flexible imaging member 10 bends over the exterior surfaces of rollers of a belt module within an electrophotographic imaging apparatus, the bottom surface 34 of the flexible imaging member belt 10 is compressed. In contrast, the top surface 32 is stretched under tension. This is attributable to the fact that the top surface 32 and bottom surface 34 move in a circular path about the circular roller. Since the top surface 32 is at greater radial distance from the center of the circular roller than the bottom surface 34, the top surface 32 must travel a greater distance than the bottom surface 34 in the same time period. Therefore, the top surface 32 must be stretched under tension relative to a generally central portion of the flexible imaging member belt 10 (the portion of the flexible imaging member belt 10 generally extending along the center of gravity of the flexible imaging member belt 10). Likewise, the bottom surface 34 must be compressed relative to the generally central portion of the flexible imaging member belt 10 (the portion of the flexible imaging member belt 10 generally extending along the center of gravity of the flexible member 10). Consequently, the bending stress at the junction 76 will be tension stress, and the bending stress at the junction 78 will be compression stress.

Compression stresses, such as at the junction point 78, rarely cause seam 30 failure. Tension stresses, such as at junction point 76, however, are a more significant problem. The tension stress concentration at the junction 76 will eventually lead to crack initiation through the electrically active layers of the flexible imaging member belt 10 as illustrated in FIG. 3. Crack 80 is adjacent to the top splashing 68 of the second end marginal region 14 of the flexible imaging member belt 10. The generally vertically extending crack 80 initiated in the charge transport layer 16 continues to propagate through the generator layer 18. Inevitably, the crack 80 extends generally horizontally to develop seam delamination 81 which is propagated through the relatively weak adhesion bond between the adjoining surfaces of the generator layer 18 and the interface layer 20.

The formation of the local seam delamination 81 is typically referred to as seam puffing. The excess thickness of the splashing 68 and stress concentration at the junction 76 causes the flexible imaging member belt 10 to perform, during extended machine operation, as if a material defect existed therein. Thus, the splashing 68 tends to promote the development of dynamic fatigue failure of seam 30 and can lead to separation of the joined end marginal regions 12 and 14 leading to severing of the flexible member belt 10. Consequently, the service life of the flexible imaging member belt 10 is shortened.

In addition to seam failure, the crack 80 acts as a depository site and collects toner, paper fibers, dirt, debris and other unwanted materials during electrophotographic imaging and cleaning processes of the flexible imaging member belt 10. For example, during the cleaning process, a cleaning instrument, such as a cleaning blade, will repeatedly pass over the crack 80. As the site of the crack 80 becomes filled with debris, the cleaning instrument dislodges at least a portion of this highly concentrated level of debris from the crack 80. The amount of the debris, however, is beyond the removal capacity of the cleaning instrument. As a consequence, the cleaning instrument dislodges the highly concentrated level of debris but cannot remove the entire amount during the cleaning process. Instead, portions of the highly concentrated debris is deposited onto the surface of the flexible imaging member belt 10. In effect, the cleaning instrument spreads the debris across the surface of the flexible imaging member belt 10 instead of removing the debris.

In addition to seam failure and debris spreading, the portion of the flexible imaging member belt 10 above the seam delamination 81, in effect, becomes a flap which moves upwardly. The upward movement of the flap presents an additional problem during the cleaning operation. The flap becomes an obstacle in the path of the cleaning instrument as the instrument travels across the surface of the flexible imaging member belt 10. The cleaning instrument eventually strikes the flap when the flap extends upwardly. As the cleaning instrument strikes the flap, great force is exerted on the cleaning instrument which can lead to instrument, for example, excessive wear and tearing of the cleaning blade. Besides damaging the cleaning blade, the striking of the flap by the cleaning instrument causes unwanted vibration in the flexible imaging member belt 10. This unwanted vibration adversely affects the copy/print quality produced by the flexible imaging member belt 10. The copy or print is affected because imaging occurs on one part of the flexible imaging member belt 10 simultaneously with the cleaning of another part of the flexible imaging member belt 10.

FIG. 4 is a schematic partial cross-sectional of a failed flexible electrophotographic imaging belt member 50 with an anti-curl back coating layer 42 formulated with a matrix resin or resins and relatively larger, broadly size distributed, and irregularly shaped POLYMIST® PTFE particles 46 and which anti-curl back layer is coated on a suitable substrate 44. The Figure also illustrates the relatively large size of protrusions and numerous protrusions of dispersed PTFE particles from the anti-curl backing layer surface and these protrusions are believed to account for the abovementioned shortcomings and compromised performance disadvantages.

Figure 5:
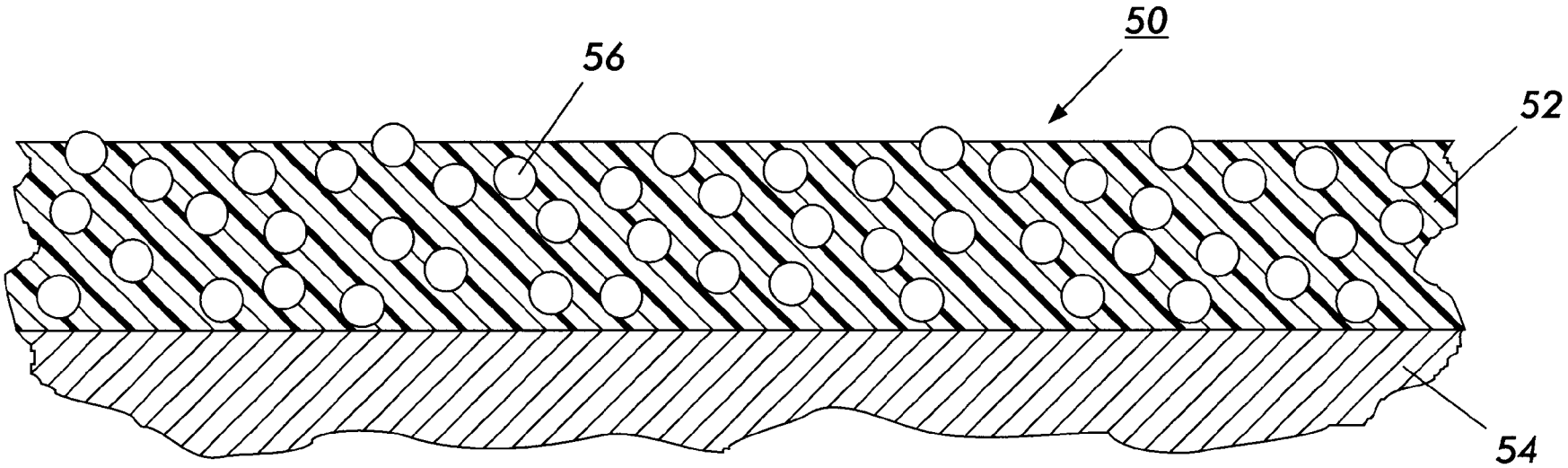
FIG. 5 is a schematic partial cross-sectional of an improved flexible electrophotographic imaging belt member of the present invention with an anti-curl back coating layer formulated with small, narrowly size distributed, and spheriodially shaped ZONYL® PTFE particles. In the drawings and the following description, it is to be understood that like numeric designations refer to components of like function.

FIG. 5 is a schematic partial cross-sectional of an exemplary flexible electrophotographic imaging belt member of the present invention with an anti-curl back coating layer 52 formulated with a matrix resin or resins and relatively smaller, narrowly size distributed, and spheriodially shaped ZONYL® PTFE particles 56 and which anti-curl back layer is coated on a suitable substrate 54. The Figure also illustrates the relatively small size of protrusions and relatively small number of protrusions of dispersed PTFE particles from the anti-curl backing layer surface and these protrusions are believed to account for the above mentioned improved performance advantages.

In addition, the rough and hard surface topology of the seam splashing is found to wear the cleaning blade and nick the contacting edge of the blade during electrophotographic imaging and cleaning processes, thereby reducing blade cleaning efficiency and shortening blade service life. However, with the incorporation of synthetic organic particles such as polytetrafluoroethylene (PTFE) particles, and sub-micrometer narrow particle size distribution PTFE in particular, dispersed in the anti-curl backing layer according to the process of the present invention, the splashing surface is lubricated by the polytetrafluoroethylene particles to ease the sliding action of the blade on the seam splashing and suppress blade wear. Furthermore, improved dispersion of polytetrafluoroethylene particles in the anti-curl backing layer also promotes improved flow of the ejected molten mass in a manner which produces a tapered splashing morphology without open pits and prevents early onset of fatigue seam cracking as well.

It is known in the art, for example U. S. Pat. No. 5,096,795, that any suitable micron-sized synthetic solid organic particles may be utilized in the anti-curl backing layer dispersions. Typical synthetic organic particles that have been used in the prior art include, for example, polytetrafluoroethylene (PTFE) commercially available as POLYMIST®, ALGOFLON®, and the like; also included are particles of waxy polyethylene, e.g., commercially available as ACUMIST®; polyvinylidene fluoride, for example, commercially available as KYNAR®; various metal stearates such as, for example, zinc stearate, and the like. Still other organic particles are disclosed in U.S. Pat. No. 5,021,309, the entire disclosure thereof being incorporated herein by reference. The particle size distribution of these organic materials is in general from about 0.5 micrometer to about 10 micrometers. Often these particles are classified to give an optimum particle size distribution is between about 0.5 micrometer and about 4.5 micrometers with an average particle size of about 2.5 micrometers provides the best particle dispersion quality in the resin matrix of the anti-curl backing layer and the ground strip layer.

When anti-curl backing layer coating solution containing dispersion of PTFE particles, such as POLYMIST®, commercially available from Ausimont U.S,A., Inc., in a solution of film forming polymer and a solvent, is applied to the back side of the substrate layer of flexible imaging member web to form an anti-curl backing layer, the dried layer, although provides outstanding wear resistance improvement, it can contain bubble defects. When fabricated into an imaging member belt and electrophotographically cycled in an imaging machine, these bubble defects prevent the anti-curl backing layer from making intimate surface contact against the belt support module drive-roller causing undesirable imaging member belt slippage due to insufficient generation of frictional force to effectively drive the belt. The dynamic imaging member belt cycling is determined to have direct impact on copy print out quality to develop print defects in the final images. Moreover, the large irregular shape particle size in micrometers dimension also was found to produce significant surface roughening topology with the manifestation of up to 0.6 micrometer surface protrusion.

To improve wear resistance, sub-micrometer size PTFE particles, such as certain ZONYL® products which are commercial available from du Pont Co. are selected for the anti-curl backing layer and ground strip layer particle dispersions of the present invention. Specific ZONYL® products include MP1100 and MP1000, and are believed to be effective because there spherical shape, they have a narrow particle size distribution of from about 0.19 to about 0.21 micrometer, and they have a small average particle size of about 0.20 micrometer. Typical ZONYL® PTFE particle dispersion concentration used in the outer exposed anti-curl backing layer and ground strip layer can be from about 0.1 weight percent and about 30 weight percent based on the total dried weight of the dried anti-curl backing layer. These concentrations are found to yield effective wear resistance in the finished imaging members. These imaging belt members are then utilized for xerographic imaging in electrophotographic imaging systems. In one embodiment, a typical dried anti-curl backing layer of the flexible electrophotographic imaging belt member fabricated in accordance with the present invention, for example, containing the above-mentioned PTFE particles dispersed in a film forming polymer matrix provides excellent mechanical results including improving wear resistance of the anti-curl backing layer and the ground strip layer. Although a PTFE particle dispersion level from about 0.1 to about 30 percent by weight, based on the total dried weight of each resulting dried layer of the flexible electrophotographic imaging member belt gives satisfactory results, a particle dispersion of between about 2 percent and about 15 percent by weight is preferred and typically yields optimum wear resistance and minimum surface particle protrusion. The resulting anti-curl backing layer containing the sub-micrometer, for example, 0.20 micrometer average particle size, ZONYL® PTFE particle dispersion is optically clear upon exposure to a 780 nanometers (0.78 micrometers) infrared radiation.

Any suitable film forming polymer may be utilized for the matrix of the anti-curl layer and the ground strip layer of this invention. The film forming polymer should be soluble in the specific carrier liquid used. Typical film forming polymers include, for example, polycarbonate, polystyrene, ARDEL® polyacrylate, polyvinyl chloride, polyacrylate, polyurethane, polyester, polysulfone, and the like polymers. Preferably, the dried anti-curl backing layer dispersion comprises from about 69.7 to about 99.7 percent by weight of the film forming polymer, based on the total dried weight of the layer.

Any suitable volatile carrier liquid may be utilized in the anti-curl backing layer coating dispersion of this invention. Typical volatile carrier liquid include, for example, methylene chloride, toluene, chlorobenzene, THF, hexane, cyclohexane, heptane, and the like. Preferably, the anti-curl backing layer coating dispersion comprises from about 75 percent by weight to about 95 percent by weight of volatile carrier liquid, based on the total weight of the coating dispersion. The specific volatile carrier liquid selected for the coating solution preparation depends upon the specific film forming polymer and PTFE particles used in the dispersion. The volatile carrier liquid should preferably dissolve the film forming polymer but not the dispersed particles.

Any suitable known coating technique may be used to coat the anti-curl backing layer coating dispersion on the substrate surface. Typical coating techniques include, for example, extrusion coating, spraying, dip coating, roll coating, wire wound rod coating, gravure coating, Bird applicator coating, and the like methodologies.

Any suitable technique may be utilize to dry the deposited anti-curl backing layer dispersion coating. Typical coating techniques include, for example, oven drying, forced air drying, focussed infrared drying, RF drying, laser drying, microwave radiation, and the like. After drying, the dried anti-curl backing layer is typically free of bubbles or entrapped gas particles. The dried anti-curl backing layer should have a thickness sufficient to counteract the tendency of the flexible photoreceptor to curl after the imaging layers have been applied. That is, the dried anti-curl backing layer should cause an unrestrained flexible photoreceptor sheet to lie flat on a flat surface. Thus, the thickness of the dried anti-curl backing layer will depend on the specific materials in and thicknesses of the other layers of any given photoreceptor. Preferably, the thickness of a dried anti-curl backing layer is from about 10 micrometers to 25 micrometers. However, other thickness be used as long as the objectives of this invention are satisfied.

The flexible substrate to which the anti-curl backing layer of this invention is applied may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, polysulfones, and the like materials which are flexible when fashioned into thin webs. The electrically insulating or conductive substrate should be flexible and in the form of a web, sheet or endless flexible belt. Preferably, the substrate comprises a commercially available biaxially oriented polyester known as MYLAR from du Pont Co. or MELINEX® available from I.C.I. Americas, Inc. or HOSTAPHAN®, available from American Hoechst Corp.

The thickness of the substrate layer depends on numerous factors, including beam strength and economical considerations, and thus this layer for a flexible belt may be of substantial thickness, for example, about 175 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, for example, 19 millimeters diameter rollers.

The conductive layer on the flexible substrate may vary in thickness over substantially wide ranges depending on the optical transparency and degree of flexibility desired for the electrostatographic member. Accordingly, for a flexible photoresponsive imaging device, the thickness of the conductive layer may be between about 20 Angstrom units to about 750 Angstroms, and more preferably from about 100 to about 200 Angstroms for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers can be combinations of materials such as conductive indium tin oxide as a transparent layer for light having a wavelength between about 4,000 and about 7,000 Angstroms or a transparent copper iodide (CuI) or a conductive carbon black dispersed in a plastic binder as an opaque conductive layer.

An optional charge blocking layer may be applied to the electrically conductive surface prior to or subsequent to application of the anti-curl backing layer to the opposite side of the substrate. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. Nos. 4,338,387, 4,286,033 and 4,291,110, the disclosures of these patents are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating, and the like techniques. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, du Pont 49,000 available from du Pont Company, VITEL® PE100 available from Goodyear Tire & Rubber, polyurethanes, and the like materials. Satisfactory results may be achieved with adhesive layer thickness of about 0.05 micrometers (500 Angstroms) and about 0.3 micrometer (3,000 Angstroms). Conventional techniques for applying an adhesive layer coating mixture to the charge blocking layer include spraying, dip coating, roll coating, wire wound rod coating, gravure coating, Bird applicator coating, and the like techniques. Drying of the deposited coating may be effected by any suitable conventional technique such as oven drying, infra-red radiation drying, air drying, and the like techniques.

Any suitable photogenerating layer may be applied to the adhesive blocking layer which can then be overcoated with a contiguous hole transport layer as described herein. Examples of typical photogenerator layers include inorganic photoconductive particles such as amorphous selenium, trigonal selenium, and selenium alloys including selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradenames Monastral Red, Monastral violet and Monastral Red Y, Vat orange 1 and Vat orange 3 tradenames for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multiphotogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulhones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, polyvinylcarbazole, and the like. These polymers can include block, random, gradient, alternating, and the like copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and additionally or alternatively pigments, and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thickness outside these ranges can be selected provided that the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra-red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This converts the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multi-layered photoconductor of the present invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound. Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3'-methylphenyl)-(1,1'-biphenyl)-4,4'-diamine, and the like dispersed in an inactive resin binder.

Any suitable inactive thermoplastic resin binder which is soluble in methylene chloride or other suitable solvent may be employed in the present invention to form the thermoplastic polymer matrix or one or more of the layers of the imaging member including the charge transport layer. Typical inactive resin binders soluble in methylene chloride include polycarbonate resin, polyvinylcarbazole, polyester, polyacrylate, polyacrylate, polyether, polysulfone, polystyrene, polyamide, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra-red radiation drying, air drying and the like.

Generally, the thickness of the charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Preferred electrically inactive resin materials are polycarbonate resins with a molecular weight from about 20,000 to about 150,000, and more preferably from about 50,000 to about 120,000. A most preferred electrically inactive resin material is poly(4,4'-dipropylidene-diphenylene carbonate) with a molecular weight of from about 35,000 to about 40,000, available as LEXAN® 145 from General Electric Company; poly(4,4'-isopropylidene-diphenylene carbonate) with a molecular weight of from about 40,000 to about 45,000, available as LEXAN® 141 from the General Electric Company; a polycarbonate resin having a molecular weight of from about 50,000 to about 120,000, available as MAKROLON® from Farbenfabricken Bayer A. G.; and a polycarbonate resin having a molecular weight of from about 20,000 to about 50,000 available as MERLON® from Mobay Chemical Company. Methylene chloride solvent is a desirable component of the charge transport layer coating mixture and insures adequate dissolution of all the components and for its low boiling point and volatility.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507, the disclosures of which are incorporated herein in their entirety. The photoreceptors may comprise, for example, a charge generator layer sandwiched between a conductive surface and a charge transport layer as described above or a charge transport layer sandwiched between a conductive surface and a charge generator layer.

If desired, a charge transport layer may comprise electrically active resin materials instead of or mixtures of inactive resin materials with activating compounds. Electrically active resin materials are well known in the art. Typical electrically active resin materials include, for example, polymeric arylamine compounds and related polymers described in U.S. Pat. Nos. 4,801,517, 4,806,444, 4,818,650, 4,806,443 and 5,030,532, and polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiarybutylmethyl silylene), poly (phenylethyl silylene), poly(n-propylmethyl silylene), poly (p-tolylmethyl silylene), poly(cyclotrimethylene silylene), poly(cyclotetramethylene silylene), poly (cyclopentamethylene silylene), poly(di-t-butyl silylene-co-di-methyl silylene), poly(diphenyl silylene-co-phenylmethyl silylene), poly(cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4 -pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516, the disclosures of each of the patents identified above pertaining to binders having charge transport capabilities are incorporated herein by reference in their entirety.

Other layers such as the electrically conductive ground strip of this invention is coated adjacent to the charge transport layer and along one edge of the belt in contact with the conductive layer, blocking layer, adhesive layer or charge generating layer to facilitate connection of the electrically conductive layer of the photoreceptor to ground or to an electrical bias. Ground strip formulations are well known in the art, and in this invention, can include, for example, conductive particles in addition to the sub-micrometer PTFE particles dispersed in a suitable film forming binder.

An optional overcoat layer can be utilized to protect the charge transport layer and improve resistance to abrasion. These overcoat layers are well known in the art and may comprise thermoplastic organic polymers or inorganic polymers that are electrically insulating or slightly semi-conductive.

For electrographic imaging members, a flexible dielectric layer overlying the conductive layer may be substituted for the active photoconductive layers and an anti-curl backing layer of this invention is also used to provide desired imaging member flatness. Any suitable, conventional, flexible, electrically insulating, thermoplastic dielectric polymer matrix material may be used in the dielectric layer of the electrographic imaging member. If desired, the flexible belts of this invention may be used for other purposes where cycling durability is important.

The advantageous effects achieved with the enhanced anti-curl backing layer fabrication utilizing the particle dispersion concept described above are achieved by using the dispersed ZONYL® PTFE particles in the material matrix of the outer exposed layers without producing any notable negative electrical impact on the final electrophotographic imaging member belt. Thus, the anti-curl backing layer formulation of this invention eliminates the formation of bubbles in the dried anti-curl backing layer. Elimination of the bubbles improves thickness uniformity of the layer and reduces mechanical wear rate. Further, elimination of the bubbles improves rear erase processes of a photoreceptor by achieving more uniform discharge. Also, open pits in the seam splashing are avoided and this result reduces undesirable dirt and increases cleaning blade life.

The invention will further be illustrated in the following non-limiting examples, it being understood that these examples are intended to be illustrative only and that the invention is not intended to be limited to the materials, conditions, process parameters and the like recited herein. All proportions are by weight unless otherwise indicated.

Control Example I

CONTROL IMAGING MEMBER PREPARATION A flexible electrophotographic imaging member web stock was prepared by providing a 0.02 micrometer thick titanium layer coated on a flexible polyester substrate (MELINEX 442, available from I.C.I. Americas, Inc.) having a thickness of 3 mils (76.2 micrometers) and applying thereto, by a gravure coating process, a solution containing 10 grams gamma aminopropyltriethoxy silane, 10.1 grams distilled water, 3 grams acetic acid, 684.8 grams of 200 proof denatured alcohol and 200 grams heptane. This layer was then dried at 135° C. in a forced air oven. The resulting blocking layer had an average dry thickness of 0.05 micrometer measured with an ellipsometer.

An adhesive interface layer was then extrusion coated by applying to the blocking layer a wet coating containing 5 percent by weight based on the total weight of the solution of polyester adhesive (MOR-ESTER 49,000, available from Morton International, Inc.) in a 70:30 volume ratio mixture of tetrahydrofuran/cyclohexanone. The resulting adhesive interface layer, after passing through an oven, had a dry thickness of 0.065 micrometers.

The adhesive interface layer was thereafter coated, by extrusion, with a photogenerating layer (CGL) containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mL of a 1:1 volume ratio of a mixture of tetrahydrofuran and toluene into a 20 once amber bottle. To this solution was added 8 grams of trigonal selenium and 1,000 grams of ⅛ inch (3.2 millimeter) diameter stainless steel shot. This mixture was ball milled for 72 to 96 hours. Next, 50 grams of polyvinyl carbazole and 2.0 grams of N,N'-diphenyl-N,N'-bis(3-methylphenyl)-1,1'-biphenyl-4,4'-diamine dissolved in 75 mL of 1:1 volume ratio of tetrahydrofuran/toluene. This slurry was shaken on a shaker for 10 minutes. The resulting slurry was extrusion coated onto the adhesive interface layer to form a coating layer having a wet thickness of about 0.5 mil (12.7 micrometers). However, a strip about 10 millimeters wide along one edge of the substrate bearing the blocking layer and the adhesive layer was deliberately left uncoated by any of the photogenerating layer material to facilitate adequate electrical contact by a ground strip layer that was applied later. This photogenerating layer was dried at 135° C. to form a dry photogenerating layer having a thickness of about 2.0 micrometers.

This coated imaging member web was simultaneously extrusion overcoated with a charge transport layer (CTL) and a ground strip layer using a 3 mil gap Bird applicator.

The charge transport layer was prepared by introducing into an amber glass bottle a 1:1 weight ratio of N,N'-diphenyl-N,N'-bis(3-methylphenyl)-1,1'-biphenyl-4,4'-diamine and MAKROLON 5705, a polycarbonate resin having a molecular weight of from about 50,000 to 100,000 and commercially available from Farbensabricken Bayer A.G. The resulting mixture was dissolved to give a 15 weight percent solids in 85 weight percent methylene chloride. This solution was applied onto the photogenerator layer to form a coating which, upon drying, had a thickness of about 24 micrometers.

The approximately 10 millimeters wide strip of the adhesive layer left uncoated by the photogenerator layer was coated with a ground strip layer during a co-coating process. This ground strip layer, after drying at 135° C. in an oven, had a dried thickness of about 14 micrometers. This ground strip was electrically grounded, by conventional means, such as a carbon brush contact during conventional xerographic imaging process. The electrophotographic imaging member web stock at this point, if unrestrained, would spontaneously curl upwardly into a 1½ inch diameter tube. Therefore, the application of an anti-curl backing layer was required to provide the desired imaging member web flatness.

An anti-curl backing layer coating solution was prepared by combining 8.82 grams of polycarbonate resin (MAKROLON® 5705, available from Bayer A.G.), 0.72 gram of polyester resin (VITEL® PE-200, available from Goodyear Tire and Rubber Company), and 90.1 grams of methylene chloride in a glass container to form a coating solution containing 8.9 weight percent solids. The container was covered tightly and placed on a roll mill for about 24 hours until the polycarbonate and polyester were dissolved in the methylene chloride to form the anti-curl coating solution. The anti-curl backing layer coating solution was then applied to the rear surface of the substrate, that is the side opposite the photogenerator layer and charge transport layer of the imaging member and dried at 135° C. to produce a dried anti-curl backing coating layer (ACBC or ACBL) with a thickness of about 13.5 micrometers. The resulting electrophotographic imaging member web stock had the desired flatness and with a structure similar to that shown schematically in FIG. 2. The fabricated electrophotographic imaging member web stock was used to serve as an imaging member control.

Comparative Example II

COMPARATIVE IMAGING MEMBER PREPARATION A flexible electrophotographic imaging member web stock was prepared by following the procedures and using materials as described in the Control Example I with the exception that the aforementioned anti-curl coating solution additionally contained a 10 weight percent based on the total solids content of a POLYMIST® dispersion which consisted of polytetrafluoroethylene (PTFE) particles, available from Ausimomt USA, Inc.

The POLYMIST® particles consist of irregularly shaped PTFE particles that are commercially produced from first, suspension polymerization of tetrafluoroethylene, second, exposure of the resulting particles to an electron beam or gamma ray radiation, and third, mechanical grinding of the irradiated particles. Commercially available POLYMIST® has a particle size distribution range of from about 0.5 micrometers to about 9.5 micrometers.

For the preparation of a POLYMIST® containing anti-curl backing layer dispersion, commercially available POLYMIST® particles were classified by conventional classification to remove larger size particles and give a preferred narrower particle size distribution of from about 0.5 micrometers to about 4.5 micrometers with an average particle size of about 2.5 micrometers. During the preparation of the anti-curl coating solution, a specific amount of the POLYMIST® particles after classification were used to disperse into the coating solution, that is 10 percent by weight particles with respect to the total weight of solids in the solution, with the aid of an attritor. The POLYMIST® dispersion was applied wet on the backside of the substrate of the imaging member web stock and then dried. The resulting dried anti-curl backing layer was observed to have numerous fine bubbles present in the matrix of the layer. These bubbles were unacceptable for high quality imaging member belts, because sufficient intimate surface contact between the anti-curl backing layer and the drive-roller of a belt support roller could not be established to generate adequate frictional force to effectively drive the belt and provide uniform belt motion quality. Consequently, slippage occurred during electrophotographic imaging machine operation using the finished belt. The imaging member belt slippage problem was found to be responsible for print defects in the electrophotographically imaged copies. Moreover, the bubbles present in the anti-curl backing layer can also cause light scattering effects which change the optical clarity of the anti-curl backing layer thereby adversely affecting the effectiveness of erase efficiency, such as accomplished by the known imaging member belt back-illumination erase process.

Example III

IMAGING MEMBER PREPARATION A flexible electrophotographic imaging member web stock was prepared according to Comparative Example II with the exception that the POLYMIST® dispersion in the anti-curl backing layer coating solution was replaced with ZONYL® MP1100, a commercial product of PTFE particles available from E.I. du Pont de Nemours & Company, to give a 10 weight percent dispersion of ZONYL® MP1100 particles in the resulting dry anti-curl backing layer.

ZONYL® MP1100 consists of small spherical shape PTFE particles prepared by a dispersion polymerization process. The small particle product obtained from this process possess a distinctive narrow particle size distribution of from about 0.19 micrometers to about 0.21 micrometers and an average primary particle size of about 0.20 micrometers. The ZONYL® MP1100 is also an electron-beam irradiated product. Since the initially formed PTFE particles are soft and are typically agglomerated into clustered particulates, the irradiation of the product provides an adequate degree of crosslinking and impart hardness to the PTFE particle, thereby making these cluster particulates more friable in response to the shear forces generated by the attritor and facilitate break-up of the agglomerates into primary particle size during preparation of the coating solution, and consequently facilitates homogeneous particle dispersion in the resin matrix material of the coated anti-curl backing layer. The resulting imaging member webstock after drying had an anti-curl backing layer free of bubble defects in the matrix material of the dried coating layer.

Example IV

IMAGING MEMBER PREPARATION A flexible electrophotographic imaging member web stock was prepared according to Example III, with the exception that the resulting anti-curl backing layer contained ZONYL® MP1000 dispersion, an alternate PTFE product commercially available from du Pont. Since ZONYL® MP1000 is prepared by a similar process as the abovementioned ZONYL® MP1100, the MP1000 particles are also spherical in shape, have about the same particle size distribution, and have the same average primary particle size as the ZONYL® MP1000. However, the ZONYL® MP1000 product differs in that it received a lower dose of electron beam irradiation, which required a longer coating solution attrition time in order to break up particle agglomerates into primary particles and to effect homogeneous particle dispersion. The resulting dried anti-curl backing layer prepared with ZONYL® MP1000 on the imaging member web stock had no apparent bubble defects.

Example V

FRICTIONAL WEAR AND RESISTANCE EVALUATION

The electrophotographic imaging member web stocks of the above Control Example 1, Comparative Example II, and Examples III and IV were evaluated for interfacial contact friction interaction between the charge transport layer and the anti-curl backing layer to assess surface frictional forces that arise between these two contacting surfaces in a 6,000 foot wound up roll of an imaging member web stock. More specifically, the effect of the dispersed PTFE particles in the anti-curl backing layer on reduction of surface contact friction against the charge transport layer was determined. The coefficient of friction test was carried out by fastening a sample of an imaging member from each of the above mentioned Examples to a flat platform surface with the charge transport layer facing upwardly. Another identical imaging member sample from each Example was secured to the flat surface of the bottom of a horizontally sliding plate weighing 200 grams with the anti-curl backing layer of the sample facing outwardly away from the sliding plate. The sliding plate was then dragged, with the anti-curl backing layer facing downwardly, in a straight line over the platform so that the horizontal anti-curl backing layer surface moved while in frictional engagement with the horizontal charge transport layer surface. The sliding plate was moved by a cable having one end attached to the plate and having the other end threaded around a freely rotatable pulley and fastened to the jaw of an INSTRON Tensile Tester. The pulley was positioned so that the segment of the cable between the weight and the pulley was parallel to the flat horizontal platform surface. The cable was pulled vertically upward from the pulley by the jaw of the INSTRON Tensile Tester and the load required to slide the sliding plate, with the anti-curl backing layer surface against the charge transport layer surface, was monitored using a chart recorder. The coefficient of friction between the charge transport layer and the anti-curl backing layer was then calculated by dividing the sliding force or load recorded by the chart recorder by 200 grams.

The coefficient of surface contact friction results obtained for the charge transport layer (CTL) against the anti-curl backing layer (ACBL) are tabulated in the Table I:

TABLE I

| Example | PTFE Dispersion in ACBL(weight percent) | Coeff. of Friction CTL/ACBL |
|---|---|---|
| I (Control) | 0 | 3.22 |
| II | 10% POLYMIST ® | 0.53 |
| III | 10% ZONYL ® MP1100 | 0.61 |
| IV | 10% ZONYL ® MP1000 | 0.60 |

The data in the table indicates that dispersion of PTFE particles, whether POLYMIST®, MP1100, or MP1000, in the imaging member web anti-curl backing layer matrix at a concentration of 10 weight percent was very effective in reducing the charge transport layer/anti-curl backing layer surface contact friction value compared to the control. This condition eased the sliding action at the contacting surface in a wound up imaging member web stock and thereby eliminated dimples, creases, and puckering physical defects in the imaging member coating layer, and which defects are often observed in the rejected segments of a roll-up imaging member web stock of Control Example I which had a significantly higher CTL/ACBL interfacial friction value compared to those observed in the samples containing PTFE particles dispersed in the anti-curl backing layer. Although not wanting to be limited by theory it is believed that in Example II, the 10% POLYMIST® particle dispersion in the anti-curl backing layer, produced a slightly lower coefficient of friction value (0.53, coefficient of surface contact friction ) than the values for the anti-curl backing layers prepared from ZONYL® particle dispersions (0.61 and 0.60) because POLYMIST® particles possess greater levels surface protrusion or surface roughness which translates into a rougher surface topology for the finished anti-curl backing layer. Additionally, since POLYMIST® had greater breadth in particle size distribution, ranging from about 0.5 to about 4.5 micrometers and with an average particle size of about 2.5 micrometers, compared to the sub-micrometer ZONYL® MP1100 and MP1000 particulate materials, each having a near mono-modal particle size distribution of from about 0.19 to about 0.21 micrometers and an average particle size of about 0.2 micrometers, the anti-curl backing layer made from a POLYMIST® particle dispersion had surface particle protrusions of up to about 0.65 micrometers in height as measured, for example, with a micro-stylus, from the surface of the bulk film to the top of the particle protrusion. The ZONYL® particle dispersions had surface protrusion that were significantly less, for example, about 0.05 micrometers surface particle protrusion as seen by transmission electron microscopy in the anti-curl backing layers of Examples III and IV. Furthermore, the sub-micrometer ZONYL® PTFE dispersions also provide a resulting anti-curl backing layer which was optically clear and effective in a xerographic machine using, for example, a 780 nanometers infrared radiation back erase. Another benefit of the spherical morphology of ZONYL® PTFE particles over the irregularly shaped POLYMIST® particles was that once dispersed in the coating formulation the ZONYL® PTFE particles did not entrap air or air bubbles on their surfaces and which entrapped air can cause undesirable bubbles to form in the matrix material of the coating layer even after thorough drying.

Samples of the electrophotographic imaging member web materials of Examples I through IV were cut to a size of 1 inch (2.54 centimeters) by 12 inches (30.48 centimeters) and tested for resistance to wear. Testing was accomplished with a dynamic mechanical cycling device which skids glass tubes across the surface of the charge transport layer of each imaging member sample. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch (0.17 kilogram per centimeters) width tension on the sample. The outer surface of the imaging member bearing the anti-curl backing layer faced downwardly so that it would periodically be brought into sliding mechanical contact with the glass tubes. The glass tubes had a diameter of one inch (2.54 centimeters). Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the anti-curl backing layer surface was away from the weighted end of the sample toward the end clamped to the stationary post. Since there were three glass tubes in the test device, each complete rotation of the disk was equivalent to three wear cycles in which the surface of the anti-curl backing layer was in sliding mechanical contact with a single stationary support tube. The rotation of the spinning disk was adjusted to provide the equivalent of 11.3 inches (28.7 centimeters) per second tangential speed. The extent of anti-curl backing layer wear was measured using a permascope at the end of a 330,000 wear cycles test. The wear testing results obtained clearly established that the PTFE dispersion of any kind gave significant and about equivalent anti-curl backing layer wear enhancement over the control anti-curl backing layer counterpart. At a 10 percent by weight PTFE dispersion, the wear resistance of the anti-curl backing layer in the imaging member webstock of Examples II, III, and IV was found to be more than 500 times above the result obtained for the anti-curl backing layer of Control Example I.

Table II summarizes formulational and characterizational differences between imaging members prepared from POLYMIST® and the ZONYL® particles dispersions.

TABLE II

| PTFE | PTFE Particle Properties | | | | Protrusions | |
|---|---|---|---|---|---|---|
| Dispersion in ACBL | Shape | Size Distribution (microns) | Ave. Size (microns) | Bubbles in ACBL | from Surface (microns) | Light Scattering[1.] |
| 10% POLYMIST ® | Irregular | 0.5 to 4.5 | 2.5 | Yes | 0.65 | Yes |
| 10% ZONYL ® | Spherical | 0.19 to 0.21 | 0.2 | None | 0.05 | Nil |

[1.]Exposure to 780 nanometer wavelength radiation.

Example VI

GROUND STRIP FORMULATION An electrically conductive ground strip can be coated adjacent to the charge transport layer and along one edge of the belt and in contact with the conductive layer, blocking layer, adhesive layer, or charge generating layer to facilitate connection of the electrically conductive layer of the photoreceptor to ground or to an electrical bias. A typical ground strip layer coating solution used for the imaging member of the above Control Example I was prepared by mixing 5.25 grams of polycarbonate resin (MAKROLON 5705 available from Bayer AG) with 73.17 grams of methylene chloride in a glass bottle and placed on a roll mill for about 24 hours until the polycarbonate was dissolved in the methylene chloride. The resulting solution was mixed for 30 minutes with about 20.72 grams of a graphite dispersion (12.3 percent by weight solid) of 9.41 parts by weight graphite, 2.87 parts by weight ethyl cellulose (available from Acheson Colloids Company), and 87.7 parts by weight methylene chloride with the use of a high shear blade disperser (Tekmar Dispax Disperser). The final dispersion was then adjusted with the addition of methylene chloride to give a ground strip layer coating mixture with a viscosity of between about 325 and about 375 centipoise in an imaging member application. Ground strip formulations are well known in the art, as described in details, for example in U. S. Pat. No. 4,664,995, and can include, for example, conductive particles in addition to the sub-micrometer PTFE particles dispersed in a suitable film forming binder of the present invention.

Example VII

IMAGING MEMBER EVALUATION: The flexible electrophotographic imaging member webstocks of Control Example I, Comparative Example II, and Examples III and IV were each cut to precise dimensions of 440 millimeters width and 2,808 millimeters in length. Each cut imaging member sheet was ultrasonically welded in the long dimension to form a seamed flexible imaging member belt for fatigue dynamic electrophotographic imaging testing in a xerographic machine. The test results obtained showed that the control imaging member belt of Control Example I quickly developed a known fatigue induced belt ripple problem; the onset of 50 micrometers belt ripples was noticed after only about 60 belt cycles. The magnitude of the belt ripple was observed to grow with belt cycling time and reached a magnitude of about 500 micrometers after 10,000 belt cycles. The induced belt ripples at a magnitude of over 100 micrometers were all manifested as copy print out defects. In contrast, the onset of 50 micrometers dynamic fatigue induced imaging belt ripples, for belts of Comparative Example II, and Examples III and IV, after 60 imaging member belt cycles were suppressed with belt cycling time. Further, the magnitude of the ripples was observed to decrease to only about 25 micrometers until the end of 150,000 belt cycles. As a point of reference, belt ripples having a magnitude below about 50 micrometers have never been found to print out as a copy defect.

Although belt cycling tests showed POLYMIST® particle dispersions in the anti-curl backing layer were effective in suppressing ripple development, nevertheless the belt of Comparative Example II with bubbles in the anti-curl backing layer, were frequently found to encounter belt slippage problems as reflected in poor belt cyclic motion quality. This is believed to be attributable to the surface contact between the anti-curl backing layer and the drive-roller was insufficient to generate a constant frictional driving belt force. By comparison, the imaging member belts with bubble free anti-curl backing layers prepared according to Examples III and IV, did not exhibit any belt motion quality problems throughout the entire test.

It was also noted that the ultrasonically welded seam of the imaging member belt of Examples II, III, and IV, containing a 10% by weight PTFE dispersion in the anti-curl backing layer, had a tapered top seam splashing and the onset of seam cracking/delamination problems developed only after cycling of the belt was extended to about 20 percent more than the number of cycles when cracking/delamination problems appeared in the imaging member belt of Control Example I.

Other modifications of the present invention may occur to one of ordinary skill in the art based upon a review of the present application and these modifications, including equivalents thereof, are intended to be included within the scope of the present invention.

What is claimed is:

1. An electrostatographic imaging member comprising:

a flexible supporting substrate;

an imaging layer coated on one side of the substrate; and an anti-curl backing layer coated on the other side of the substrate which layer is comprised of a film forming polymer binder, and a dispersion of polytetrafluoroethylene particles which particles have a narrow diameter particle size distribution of from about 0.19 micrometers to about 0.21 micrometer, and an average diameter particle size of about 0.20 micrometer.

2. The electrostatographic imaging member of claim 1, further comprising a ground strip layer coated at one edge of the imaging member and adjacent to the imaging layer and which ground strip layer is comprised of a film forming polymer, a conductive graphite dispersion, and a dispersion of polytetrafluoroethylene particles which dispersion has a narrow diameter particle size distribution of from about 0.19 micrometer to about 0.21 micrometer, and an average diameter particle size of about 0.20 micrometer.

3. The electrostatographic imaging member of claim 1, wherein the polytetrafluoroethylene particles in the anti-curl backing layer are present in an amount of from about 0.1 to about 30 weight percent based on the total weight of the anti-curl layer.

4. The electrostatographic imaging member of claim 1, wherein the polytetrafluoroethylene particles in the anti-curl backing layer are present in an amount of from about 2 to about 15 weight percent based on the total weight of the anti-curl layer.

5. The electrostatographic imaging member of claim 2, wherein the polytetrafluoroethylene particles in the ground strip layer are present in an amount of from about 0.1 to about 30 weight percent based on the total weight of the ground strip layer.

6. The electrostatographic imaging member of claim 1, wherein the polytetrafluoroethylene particles are gamma ray irradiated or electron-beam irradiated.

7. The electrostatographic imaging member of claim 1, wherein the polytetrafluoroethylene particles are prepared by dispersion polymerization.

8. The electrostatographic imaging member of claim 1, wherein the polytetrafluoroethylene particles have a dry lubricating characteristic.

9. The electrostatographic imaging member of claim 1, wherein the morphology of the polytetrafluoroethylene particles is spherical.

10. The electrostatographic imaging member of claim 1, wherein the polytetrafluoroethylene particles size distribution is substantially monomodal.

11. The electrostatographic imaging member of claim 1, wherein the dispersed polytetrafluoroethylene particles are primary particles.

12. The electrostatographic imaging member of claim 1, wherein the polytetrafluoroethylene particles are uniformly and homogeneously dispersed in the binder.

13. The electrostatographic imaging member of claim 1, wherein the binder of the anti-curl backing layer is a polycarbonate.

14. The electrostatographic imaging member of claim 2, wherein the binder of the ground strip layer is a polycarbonate.

15. The electrostatographic imaging member of claim 13, wherein the polycarbonate is at least one of poly(4,4'-isopropylidene diphenylene carbonate) and 4,4,-cyclohexylidene diphenyl polycarbonate.

16. The electrostatographic imaging member of claim 1, wherein the anti-curl backing layer has a thickness of from about 0.25 to about 100 micrometers.

17. The electrostatographic imaging member of claim 1, wherein the anti-curl backing layer is optically clear to infrared radiation.

18. The electrostatographic imaging member of claim 1, wherein the anti-curl layer is substantially free of entrapped gas particles.

19. The electrostatographic imaging member of claim 1, wherein the anti-curl backing layer has a wear resistance of about 5 to about 1,000 times greater than an anti-curl layer free of the particle dispersion.

20. The electrostatographic imaging member of claim 1, wherein anti-curl backing layer has a coefficient of surface contact friction against the charge transport layer of from about 0.1 to about 0.7.

21. The electrostatographic imaging member of claim 1, wherein the anti-curl backing layer further comprises a copolyester adhesion promoter present in an amount of about 1 percent by weight to about 15 percent by weight of the anti-curl layer.

22. An electrophotographic layered imaging member respectively comprising:

an anti-curl backing layer, a flexible supporting substrate having an electrically conductive layer, a hole blocking layer, an adhesive layer, a charge-generating layer, and a charge transport layer with an optional adjacent ground strip layer, wherein the anti-curl backing layer comprises a film forming polymer binder and a dispersion of polytetrafluoroethylene particles, wherein the particles have a narrow diameter particle size distribution of from about 0.19 micrometer to about 0.21 micrometer, and an average diameter particle size of about 0.20 micrometer.

* * * * *